US008335597B2

(12) United States Patent
Hayashi et al.

(10) Patent No.: US 8,335,597 B2
(45) Date of Patent: Dec. 18, 2012

(54) REMOTE-CONTROLLED MOBILE MACHINE USING FLEXIBLE SHAFTS

(75) Inventors: Ryota Hayashi, Kagoshima (JP); Showzou Tsujio, Kagoshima (JP); Yong Yu, Kagoshima (JP)

(73) Assignee: Kagoshima University, Kagoshima (JP)

( * ) Notice: Subject to any disclaimer, the term of this patent is extended or adjusted under 35 U.S.C. 154(b) by 1318 days.

(21) Appl. No.: 12/066,357

(22) PCT Filed: Sep. 8, 2006

(86) PCT No.: PCT/JP2006/317815

§ 371 (c)(1),
(2), (4) Date: Mar. 10, 2008

(87) PCT Pub. No.: WO2007/029800

PCT Pub. Date: Mar. 15, 2007

(65) Prior Publication Data

US 2009/0281681 A1 Nov. 12, 2009

(30) Foreign Application Priority Data

Sep. 9, 2005 (JP) ..... 2005-262825

(51) Int. Cl.
*G05D 3/00* (2006.01)

(52) U.S. Cl. ..... 701/2; 701/36; 701/41; 701/69; 700/245; 700/247; 700/257; 180/6.2; 180/6.48

(58) Field of Classification Search ..... None
See application file for complete search history.

(56) References Cited

U.S. PATENT DOCUMENTS

| | | | | |
|---|---|---|---|---|
| 3,730,287 | A * | 5/1973 | Fletcher et al. | 180/6.5 |
| 4,709,265 | A * | 11/1987 | Silverman et al. | 348/158 |
| 4,977,971 | A * | 12/1990 | Crane et al. | 180/8.3 |
| 5,022,812 | A * | 6/1991 | Coughlan et al. | 414/729 |
| 5,443,354 | A * | 8/1995 | Stone et al. | 414/729 |
| 5,551,545 | A * | 9/1996 | Gelfman | 191/12.2 A |
| 6,113,343 | A * | 9/2000 | Goldenberg et al. | 414/729 |
| 6,232,735 | B1 * | 5/2001 | Baba et al. | 318/567 |
| 6,450,104 | B1 * | 9/2002 | Grant et al. | 104/138.2 |
| 7,011,171 | B1 * | 3/2006 | Poulter | 180/8.2 |
| 7,137,465 | B1 * | 11/2006 | Kerrebrock et al. | 180/22 |
| 7,331,436 | B1 * | 2/2008 | Pack et al. | 191/12.2 A |

(Continued)

FOREIGN PATENT DOCUMENTS

JP 57-150613 U 9/1982

(Continued)

OTHER PUBLICATIONS

Ryota Hayashi et al., "Remote Control of Crawler-type Robot by use of Flexible Shaft", Rescue Robot, Mobile Mechanism, Flexible Shaft, Crawler, maneuverability, Sep. 15, 2005.

*Primary Examiner* — Khoi Tran
*Assistant Examiner* — Jonathan L Sample
(74) *Attorney, Agent, or Firm* — Arent Fox LLP

(57) ABSTRACT

A remote-controlled mobile machine has a pair of flexible shafts (10) formed by inserting torque transmission driving wires (11) into tubes (12). One ends of the flexible shafts (10) are respectively connected to power sources (2), and the other ends thereof are respectively connected to a pair of left and right crawler mechanisms (102). The crawler mechanisms (102) are driven/controlled by remote control via the flexible shafts (10) to make the mobile machine travel.

8 Claims, 6 Drawing Sheets

U.S. PATENT DOCUMENTS

| | | | | |
|---|---|---|---|---|
| 7,581,605 | B2 * | 9/2009 | Caspi et al. | 180/9.1 |
| 7,597,162 | B2 * | 10/2009 | Won | 180/9.32 |
| 2004/0170363 | A1 * | 9/2004 | Angela | 385/100 |
| 2005/0027310 | A1 * | 2/2005 | Yamada et al. | 606/169 |
| 2006/0095161 | A1 * | 5/2006 | Olson | 700/259 |
| 2006/0097682 | A1 * | 5/2006 | Perrin et al. | 318/568.12 |
| 2006/0212168 | A1 * | 9/2006 | Baba et al. | 700/245 |
| 2008/0078599 | A1 * | 4/2008 | DeRocher | 180/164 |

FOREIGN PATENT DOCUMENTS

| | | | |
|---|---|---|---|
| JP | 61-139806 | A | 6/1986 |
| JP | 61-162611 | U | 10/1986 |
| JP | 4-69596 | A | 3/1992 |
| JP | 06-110548 | A | 4/1994 |
| JP | 11-264495 | A | 9/1999 |
| JP | 2003-302217 | A | 10/2003 |
| JP | 2004-188581 | A | 7/2004 |

* cited by examiner

REMOTE-CONTROLLED MOBILE MACHINE USING FLEXIBLE SHAFTS

CROSS-REFERENCE TO RELATED APPLICATION

This application is a National Stage entry of International Application No. PCT/JP2006/317815, filed Mar. 10, 2008, the entire specification claims and drawings of which are incorporated herewith by reference.

TECHNICAL FIELD

The present invention relates to a remote-controlled mobile machine using flexible shafts capable of being effectively utilized for a search inside of rubble to quickly search for victims when a disaster such as an earthquake occurs.

BACKGROUND ART

In Recent years, as an important task in rescue engineering, a study of a rescue robot for searching inside of rubble to quickly search for victims remained inside of collapsed buildings when a disaster such as an earthquake occurs is actively conducted. An effectiveness of a robot capable of traveling inside of the rubble which is so dangerous that a person cannot enter is attracting attention.

For example, Patent Document 1 discloses a rescue robot including a body, left and right crawler devices rotatably attached to both side portions of the body, and a driving device driving the crawler devices via radio control or codes.

Note that a quite large number of robots, machine devices or the like have been proposed and developed for industrial usage and the like, although not being intended for rescuing.

As for a radio-controlled rescue robot, there is a vulnerability that a command radio wave may not reach the machine being inside of the rubble. Further, as for a self-moving rescue robot, there is a risk that the rescue robot may go missing while it is conducting a searching operation inside of the rubble. Furthermore, there is a problem that the search cannot be conducted continuously enough since a period of time the rescue robot can operate is limited in terms of energy.

Meanwhile, by supplying an electric energy using wires, it is also possible to continuously conduct the searching operation for a long period of time. However, a balance between a weight of an actuator mounted on the robot main body and a driving torque needed for moving the robot is quite difficult to maintain, so that actually, the continuous searching operation cannot be realized easily.

Further, there are a lot of cases where electrical power sources are mounted on the robot main bodies, and such cases involve the risk of leading to an occurrence of fire disaster inside of the rubble where there is a chance of gas leakage.

Patent Document 1: Japanese Patent Application Laid-Open No. 2004-188581

SUMMARY OF THE INVENTION

The present invention has been made in view of the actual circumstances as described above, and an object thereof is to provide a remote-controlled mobile machine using flexible shafts excellent in mobility and safety, and capable of exhibiting a great effectiveness as a rescue robot by functioning accurately and smoothly by remote control.

A remote-controlled mobile machine using flexible shafts according to the present invention has a pair of flexible shafts formed by inserting torque transmission driving wires into tubes, in which one ends of the flexible shafts are respectively connected to power sources, and the other ends thereof are respectively connected to a pair of left and right crawler mechanisms being a driven side, and the crawler mechanisms are driven/controlled by remote control via the flexible shafts to make the mobile machine travel.

Further, in the remote-controlled mobile machine using the flexible shafts according to the present invention, the driving wire is composed of a wire of multi-layer structure having a twist direction thereof being reversed at every layer, and the crawler mechanisms are designed to rotate in a same direction or an opposite direction in accordance with coincidence or non-coincidence of rotational directions of a pair of driving wires.

Further, in the remote-controlled mobile machine using the flexible shafts according to the present invention, the pair of flexible shafts is bound together in parallel as one bundle.

Further, in the remote-controlled mobile machine using the flexible shafts according to the present invention, bearings rotatably supporting the driving wire are arranged at predetermined intervals along with a longitudinal direction of the flexible shaft.

Further, in the remote-controlled mobile machine using the flexible shafts according to the present invention, an imaging device is mounted on a main body of the mobile machine, and the mobile machine can be operated by remote control while monitoring a video obtained by the imaging device.

According to the present invention, it is possible to transmit a necessary and sufficient driving torque for conducting a searching operation, by providing large-capacity driving motors as power sources. Accordingly, the driving torque is smoothly transmitted to a crawler robot performing the searching operation in the place remote from the power sources.

Further, the flexible shafts are connected to the left and right two crawler mechanisms, and according to the coincidence or non-coincidence of rotational directions of the flexible shafts, the left and right crawler mechanisms rotate in a same direction or an opposite direction. Accordingly, it becomes possible to operate the crawler robot to move forward, to turn left or right, and to move backward, which allows the crawler robot to climb over the rubble easily and smoothly.

Further, the pair of flexible shafts is bound together in parallel as one bundle, and the flexible shafts are set to rotate in opposite directions to each other when the crawler robot moves forward or backward. Accordingly, the driving torques transmitted by the two flexible shafts are offset to each other, except when being used for moving the crawler robot, which can effectively prevent the crawler robot from falling down, which is caused by the driving torque transmitted from the power sources.

DETAILED DESCRIPTION OF THE PREFERRED EMBODIMENTS

Hereinafter, a preferred embodiment of a remote-controlled mobile machine using flexible shafts according to the present invention will be described with reference to the drawings.

Figure 1:
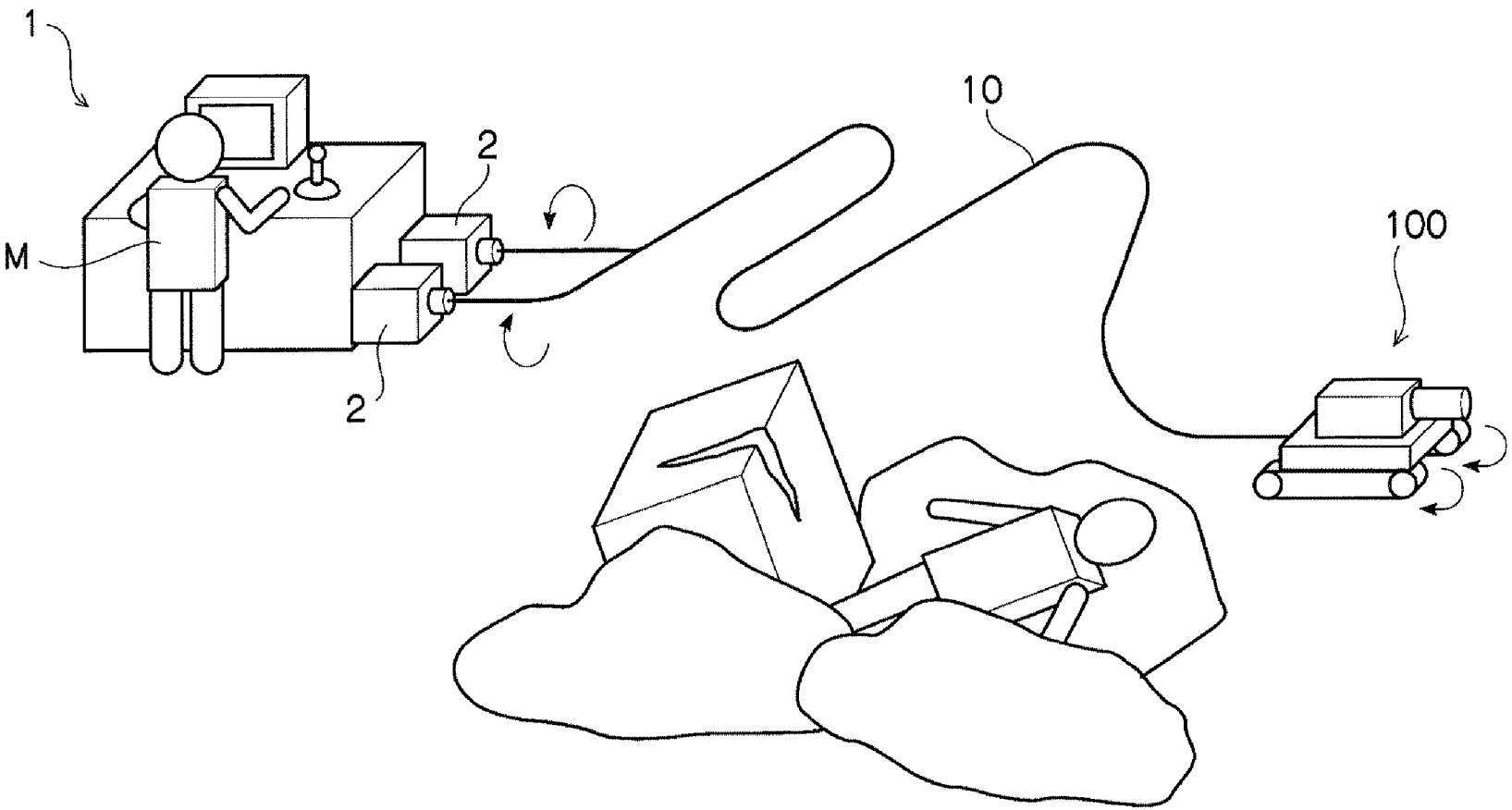
FIG. 1 is a view conceptually showing an example of a case where a remote-controlled mobile machine using flexile shafts is adopted as a crawler robot for a rescue operation according to an embodiment of the present invention.

FIG. 1 is a view conceptually showing an example of a case where the remote-controlled mobile machine using the flexile shafts is adopted as a crawler robot for a rescue operation according to the embodiment. In this example, it is assumed that a searching operation is conducted in order to check whether victims are remained in a place where there is a risk of secondary disaster such as an area of collapsed houses and the like, by remote-controlling the crawler robot from a safe place remote from the area.

An operation base 1 is disposed at a place remote from a disaster area where the victims exist, and the operation base 1 and a crawler robot 100 are connected via flexible shafts 10. A control device is disposed at the operation base 1, and the operation base 1 is equipped with two driving motors 2 driven/controlled by the control device. For the driving motors 2 used as power sources, the ones of relatively large capacity are applied, and one ends of the flexible shafts 10 are connected to rotation output shafts of the driving motors 2.

Figure 2:
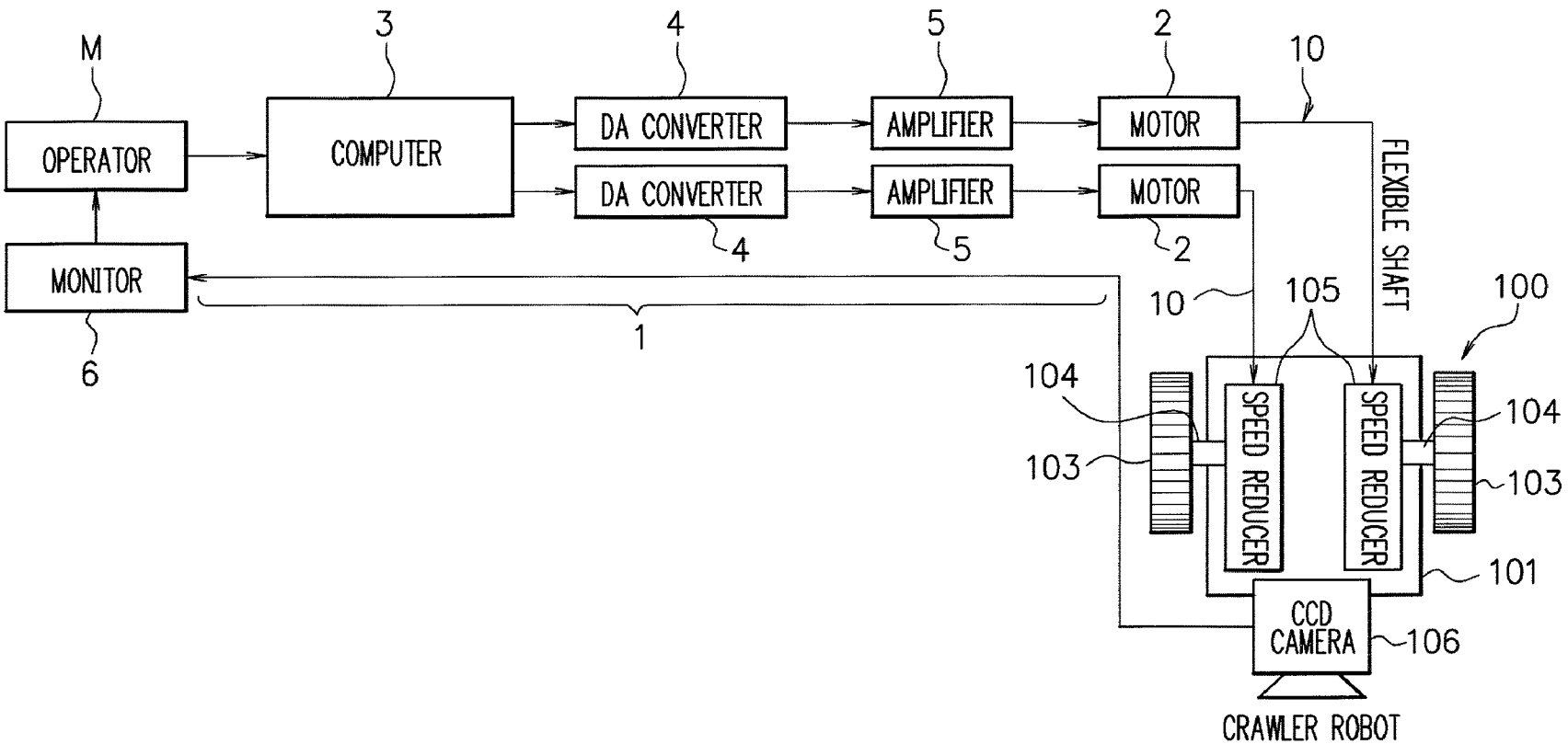
FIG. 2 is a view showing an example of a whole structure according to the embodiment of the present invention.

As shown in FIG. 2, for the control device, a personal computer 3 (hereinafter, referred to as "PC"), for example, is used, in which keys corresponding to "forward movement", "backward movement", "right turn" and "left turn" are set on a keyboard. As long as the keys are pressed by a pressing operation, a command voltage is inputted into the respective driving motors 2 from DA converters 4 via amplifiers 5, and accordingly, the crawler robot 100 performs the movement corresponding to the key operation. Further, by stopping the pressing operation of the keys, the command voltage to the driving motors 2 becomes "0" (zero), so that the crawler robot 100 stops the movement.

Figure 3:
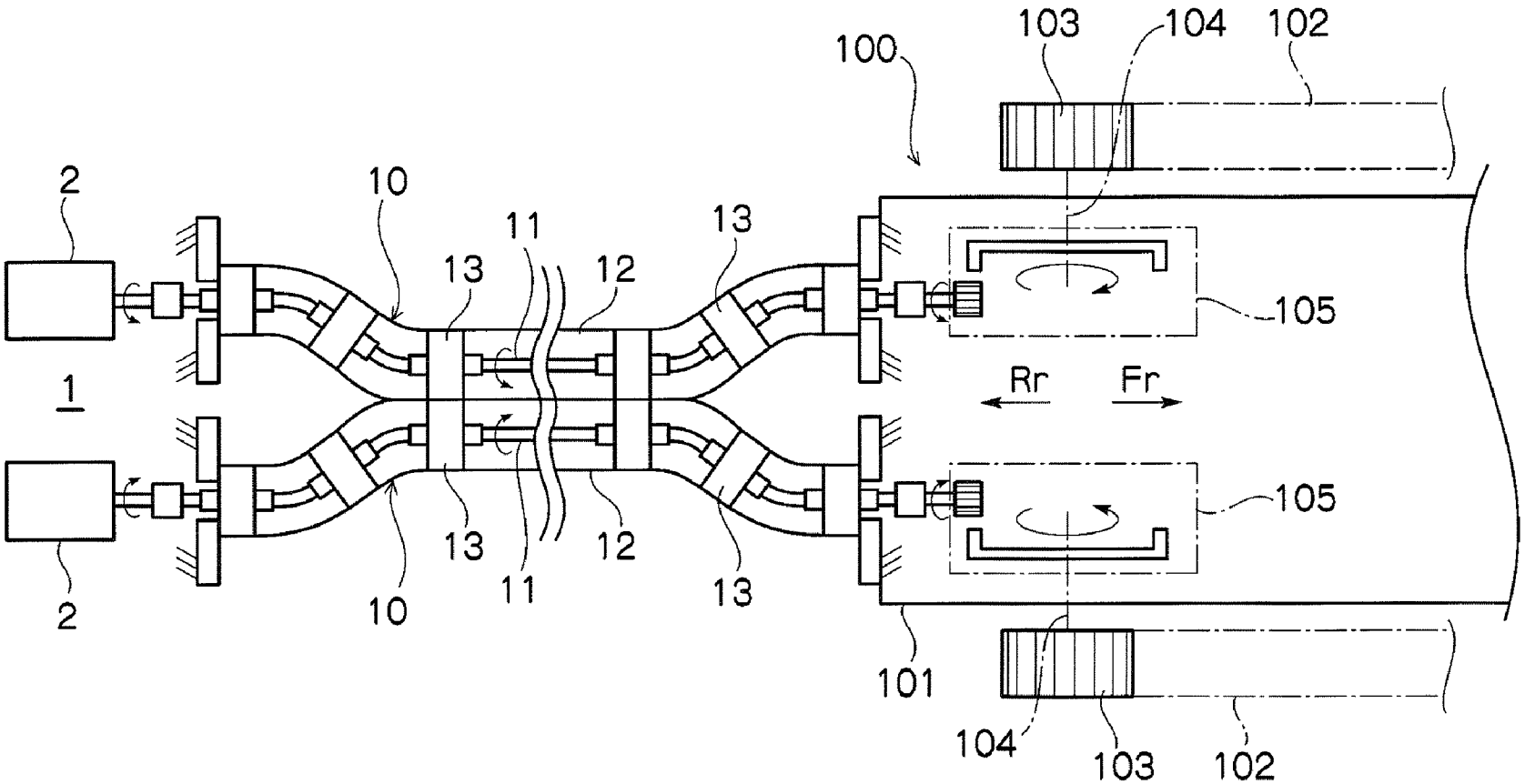
FIG. 3 is a view showing a periphery of the flexible shafts according to the embodiment of the present invention.
Figure 4:
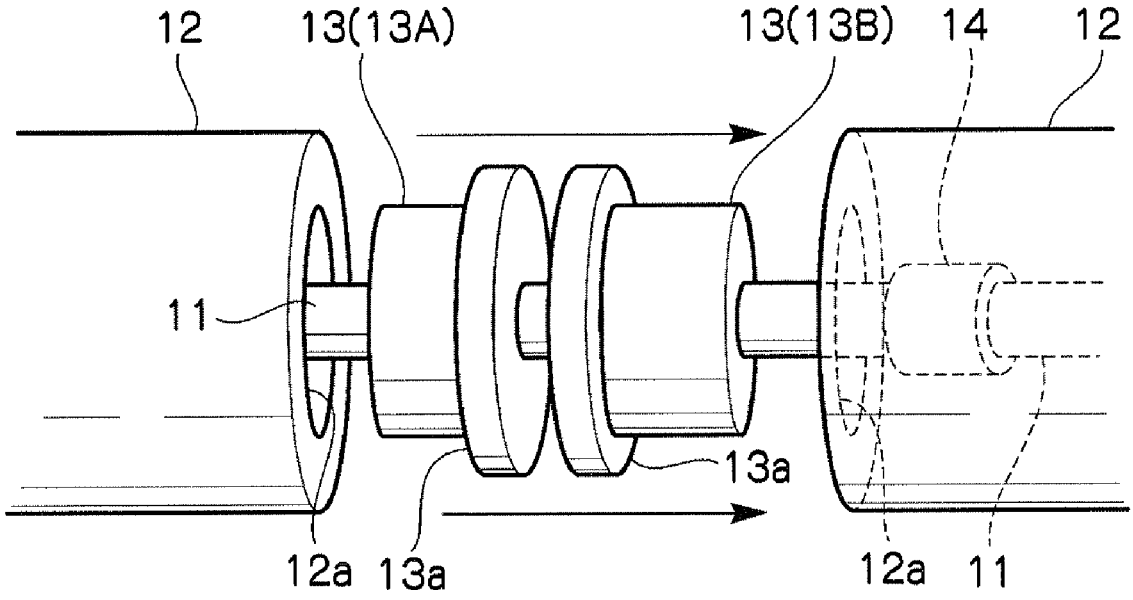
FIG. 4 is a view showing a periphery of bearings arranged on the flexible shaft according to the embodiment of the present invention.

As shown in FIG. 3, FIG. 4, and the like, the flexible shafts 10 are formed by inserting torque transmission driving wires 11 into tubes 12. In this case, one ends of the driving wires 11 are connected to the driving motors 2 being the power sources, and the other ends thereof are connected to driving wheels of the crawler robot 100 being a driven side via speed reducers, as will be described later.

The tube 12 is formed in a tube shape made of flexible and light material, such as a silicon material. It is structured such that the driving wire 11 transmitting a rotation torque is covered by the tube 12, in which the tube 12 itself does not rotate, so that the curved shape thereof is maintained.

Figure 5:
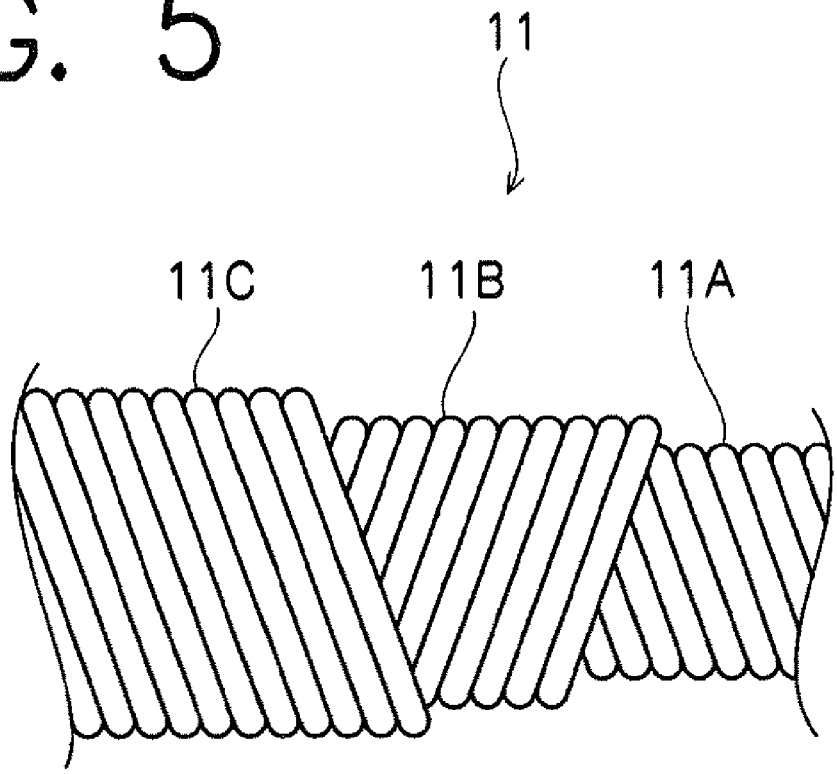
FIG. 5 is a view showing an example of a structure of a driving wire according to the embodiment of the present invention.

Here, the driving wire 11 is composed of a wire of multi-layer structure having a twist direction thereof being reversed at every layer. FIG. 5 shows an example of a concrete structure of the driving wire 11, in which the driving wire 11 includes a three-layer structure composed of an S-twisted first layer 11A, a Z-twisted second layer 11B and an S-twisted third layer 11C, using a stainless steel (typically, SUS 304) wire.

Further, as shown in FIG. 3, bearings 13 rotatably supporting the driving wire 11 are arranged at predetermined intervals along with a longitudinal direction of the flexible shaft 10. In this embodiment, as shown in FIG. 4, each of the bearings 13 is composed of a pair of flange-attached bearings 13A and 13B, in which respective flange portions 13*a* of the bearings 13A and 13B are adhered and fixed to each other. A portion of the bearing main body is pressed into an inner hole 12*a* of the tube 12, and then it is adhered and fixed.

Further, stoppers 14 are attached to close positions of sides of the bearings 13A and 13B of the respective bearings 13. The stoppers 14 are fixed to the driving wire 11, which makes it possible to prevent the bearings 13 from moving along an axial direction of the driving wire 11.

Figure 6:
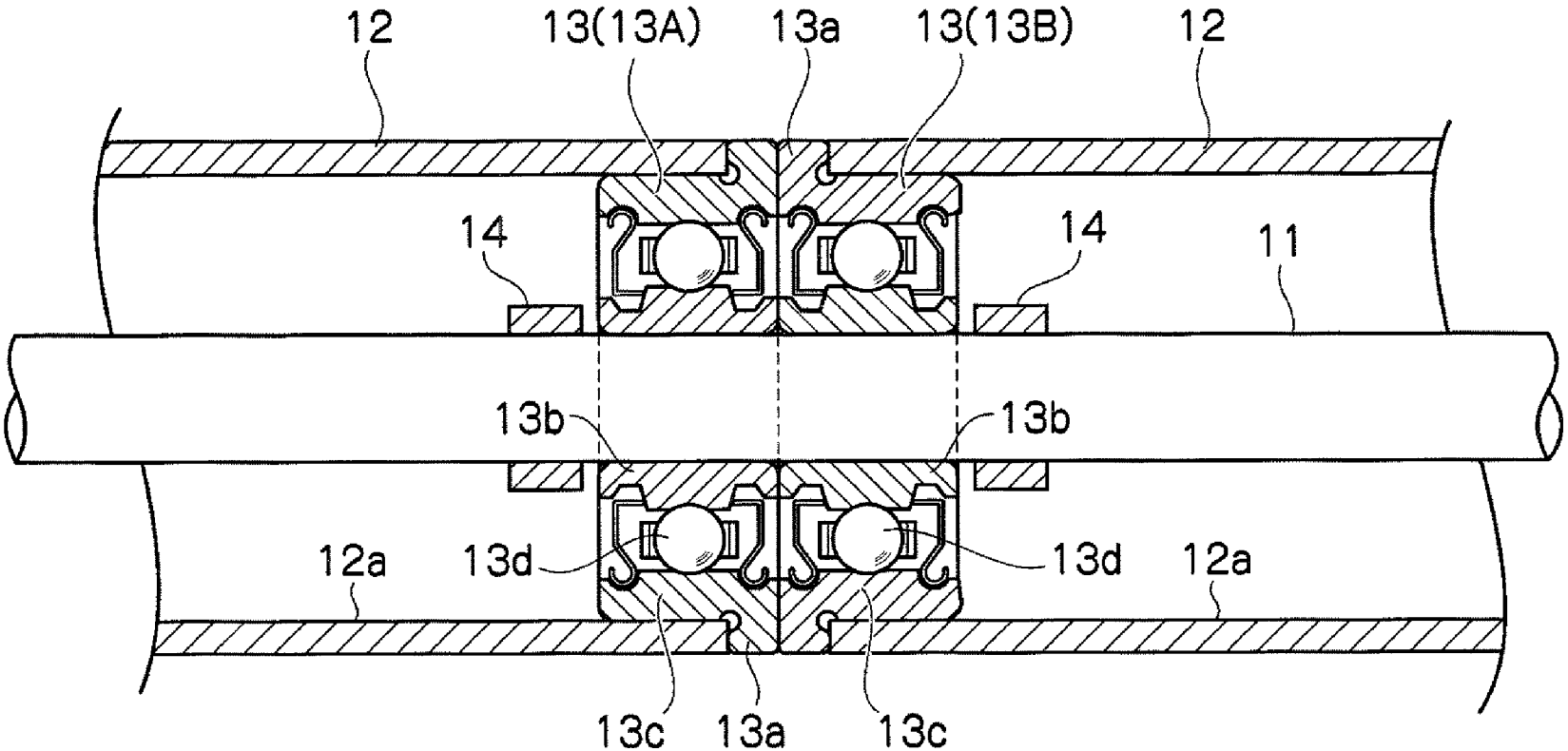
FIG. 6 is a view showing an example of a concrete structure of the periphery of the bearings arranged on the flexible shaft according to the embodiment of the present invention.

Here, FIG. 6 shows an example of a concrete structure of the bearing 13. In this example, both of the respective bearings 13A and 13B include inner rings 13*b* fixed to the side of the driving wire 11, outer rings 13*c* fixed to the side of the tube 12, and balls 13*d* provided between the inner rings and the outer rings.

Further, as shown in FIG. 3, the pair of flexible shafts 10 is bound together in parallel as one bundle. The two flexible shafts 10 are respectively connected to the pair of driving motors 2 at one ends thereof, in which the two flexible shafts 10 are bound to each other at a position as close as possible to the driving motors 2, and they are extended to the crawler robot 100 in this state, in which they are separated right before reaching the crawler robot 100.

Next, the crawler robot 100 is provided with crawler mechanisms 102 at both left and right sides of a body 101, and driving wheels 103 of the crawler mechanisms 102 are designed to rotate around axles 104. In this case, one of the flexible shafts 10 is connected to the axle 104 of the right-sided driving wheel 103 via the speed reducer 105, and the other of flexible shafts 10 is connected to the axle 104 of the left-sided driving wheel 103 via the speed reducer 105. Note that in FIG. 3, a forward direction and a rearward direction are respectively shown by arrows "Fr" and "Rr". Further, although the speed reducers 105 are simplified to be described in FIG. 3, they are structured to have a plurality of transmissions so that a transmission ratio thereof can be changed depending on the largeness or smallness of the load.

Further, an imaging device is mounted on the crawler robot 100, and the crawler robot 100 can be operated by remote control while monitoring a video obtained by the imaging device. For the imaging device, a CCD camera 106, for instance, is preferable, and a video obtained thereby can be watched at a monitor 6 of the operation base 1.

In the operation base 1, an operator M drives/controls the driving motors 2 by operating keys on the PC 3 being the control device, while watching the video shot by the CCD camera 106 at the monitor 6, as shown in FIG. 1. Accordingly, via the flexible shafts 10, the operator M can remote control the crawler robot 100 to perform the movement corresponding to the key operation.

Meanwhile, for the remote-controlled crawler robot 100 described above, following performances and so forth are required. That is, 1) The driving torque can be smoothly transmitted to the crawler robot 100 performing the searching operation in the place remote from the power sources (performance 1).

2) The crawler robot 100 can be operated to move forward, to turn left or right, and to move backward, which enables the crawler robot 100 to climb over the rubble (performance 2).

3) There is no occasion for the crawler robot 100 falls down, which is caused by the driving torque transmitted from the power sources (performance 3).

First, regarding the performance 1, by applying the wire of multi-layer structure, not the one of Z-twisted single-layer structure, it is possible to smoothly transmit the torque even when the rotational torque is applied to the portion where the wire is bent. Note that in the present invention, the power sources are not mounted on the crawler robot 100 itself, so that under this condition, it is disadvantageous in terms of energy efficiency compared to a case of applying a mobile mechanism mounted the power sources on the crawler robot itself. Concerning this point, in the present invention, by providing the large-capacity driving motors 2 as power sources, it becomes possible to transmit the necessary and sufficient driving torque for conducting the searching operation.

Regarding the performance 2, it is dealt with by applying the two flexible shafts 10 to the mobile mechanism of the crawler robot 100. As described above, the crawler robot 100 has the left and right two crawler mechanisms 102, and the left and right crawler mechanisms 102 are designed to rotate in the same direction or the opposite direction in accordance with coincidence or non-coincidence of rotational directions of the pair of driving wires 11.

Specifically, as an example illustrated in FIG. 3, for instance, when the driving wire 11 of one of the flexible shafts 10 rotates clockwise and the driving wire 11 of the other flexible shafts 10 rotates counterclockwise, the left and right crawler mechanisms 102 rotate in a same direction via the speed reducers 105 as shown in the drawing, and at this time, the crawler robot 100 moves forward. Further, when the driving wires 11 rotate in the directions opposite to the above-described directions, the left and right crawler mechanisms 102 rotate in a direction opposite to the above-described direction, in which both of them rotate in a same direction, and at this time, the crawler robot 100 moves backward. As described above, by rotating the crawler mechanisms 102 in the same direction, the crawler robot 100 can move forward or backward.

On the other hand, when the rotational directions of the driving wires 11 are the same, the crawler mechanisms 102 rotate in the opposite directions to each other, which allows the crawler robot 100 to turn right or left. In other words, in FIG. 3, for instance, when both the driving wires 11 of the two flexible shafts 10 rotate clockwise, the crawler robot 100 turns right. Further, when both the driving wires 11 rotate counterclockwise, the crawler robot 100 turns left. Note that a rotation control of the driving wires 11 can be conducted easily with accuracy by controlling the two driving motors 2 using the control device at the operation base 1.

As described above, the crawler robot 100 can be freely driven/controlled to move forward and backward, and to turn left and right. In addition to that, in the present invention, no power sources are mounted on the crawler robot 100 itself as described above, so that it is possible to construct the mobile machine of relatively light weight. Therefore, according to the above-described structure, it enables the crawler robot 100 to easily and securely climb over the rubble and the like.

Further, regarding the performance 3, a case where the crawler mechanisms 102 are stuck due to some obstructions and so forth while the crawler robot 100 is driving is assumed. In such a case, when the amount of driving torque transmitted to the crawler mechanisms 102 is increased, the increased torque itself may act on the crawler robot 100 to fall down. Concerning this point, in the present invention, the pair of flexible shafts 10 is bound together in parallel as one bundle. Further, in this case, the flexible shafts 10 (driving wires 11) are set to rotate in the opposite directions to each other when the crawler robot 100 moves forward or backward, as described above. Accordingly, the driving torques transmitted by the two flexible shafts 10 are offset to each other, except when being used for moving the crawler robot 100, so that the driving torque never acts to cause the crawler robot 100 to fall down.

In the above case, when the crawler robot 100 starts driving and the like, the flexible shafts 10 are freely deformed while taking a curved shape such as a loop shape. Under the above-described use condition, there is a need to deal with such problems that in this type of shaft having a double structure of the driving wire and the tube, generally, the inside of the tube is worn away when the driving wire is turned at high speed, and further, the driving wire together with the tube are twisted due to a high load torque. Further, when the high load torque is applied, the transmitted torque is not effectively applied to a direction in which the driving wire is rotated, which generates a phenomenon that the driving wire tends to contract strongly in an axial direction while being twisted.

As described above, the present invention applies the driving wire 11 composed of the wire of multi-layer structure having a twist direction thereof being reversed at every layer. Further, the bearings 13 are arranged at predetermined intervals along with a longitudinal direction of the flexible shaft 10, which can prevent the driving wire 11 from directly touching the tube 12. Further, by using the flange-attached bearings 13, it is possible to prevent the bearings 13 from displacing in the axial direction with respect to the tube 12. Further, the stoppers 14 fixed to the driving wire 11 prevent the bearings 13 from moving along the axial direction of the driving wire 11. According to these measures, it is possible to prevent the mutual interference between the driving wire 11 and the tube 12, and to eliminate the displacement in the axial direction between them, and therefore a smooth operation can be realized.

When a driving experiment of the above-described crawler robot 100 using the flexible shafts 10 is conducted, it is confirmed that the crawler robot 100 can freely travel on the ground as long as the flexible shafts 10 extend. Further, when the crawler robot 100 is made to climb over an obstacle under the condition of making the flexible shafts 10 to draw double loops, the crawler robot 100 moves forward to easily climb over the obstacle, and can smoothly turn thereafter.

Note that, while the preferred embodiment of the present invention has been described, the present invention is not limited to the above-described embodiment, and various modifications and the like can be appropriately adopted if required.

For instance, the example where the flexible shafts 10 have the pair of flange-attached bearings 13A and 13B has been described, but, the flexible shafts 10 can be structured to have either one of the bearings, specifically, a single bearing.

Further, although the crawler robot 100 with rear-wheel drive is shown in FIG. 3 as an example, the one with front-wheel drive can also be adopted, in which the same operation and effect as those of the above-described embodiment can be obtained. Further, the present invention can also be adopted to a crawler robot 100 provided with wheels instead of with the crawler mechanisms.

Further, the example where the PC is used as the control device has been described, but, in addition to that, the one of so-called joystick type can be applied. For instance, it is possible to construct a device having left and right two joystick levers and inputting command voltage into the driving motors by detecting inclinations of the respective levers, in which the crawler robot 100 moves forward when both the two levers are inclined rearward (front side seen from the operator), it moves backward when both the levers are inclined forward, it turns left when the right-sided lever and the left-sided lever are respectively inclined rearward and forward, and it turns right when the right-sided lever and the left-sided lever are respectively inclined forward and rearward. In this case, a magnitude of the generated torque of the driving motors can be controlled according to the inclination angles of the respective levers.

Further, the number of flexible shafts can be appropriately increased, if required. Specifically, for example, by additionally providing the crawler mechanism to an upper surface or side surface of the robot main body, it is possible to effectively secure the driving force even in the rubble.

Furthermore, when an opening/closing hand (hand with opening/closing operation mechanism) is provided with the robot main body, the flexible shaft can be used for supplying the driving torque to the opening/closing hand, which can realize the multifunction as a rescue robot.

INDUSTRIAL APPLICABILITY

According to the present invention, it is possible to transmit a necessary and sufficient driving torque for conducting a searching operation, by providing large-capacity driving motors as power sources. Accordingly, the driving torque is smoothly transmitted to a crawler robot performing the searching operation in the place remote from the power sources.

Further, flexible shafts are connected to left and right two crawler mechanisms, and according to coincidence or non-coincidence of rotational directions of the flexible shafts, the left and right crawler mechanisms rotate in a same direction or an opposite direction. Accordingly, it becomes possible to operate the crawler robot to move forward, to turn left or right, and to move backward, which allows the crawler robot to climb over rubble easily and smoothly.

Further, the pair of flexible shafts is bound together in parallel as one bundle, and the flexible shafts are set to rotate in opposite directions to each other when the crawler robot moves forward or backward. Accordingly, the driving torques transmitted by the two flexible shafts are offset to each other, except when being used for moving the crawler robot, which can effectively prevent the crawler robot from falling down, which is caused by the driving torque transmitted from the power sources.

What is claimed is:

1. A remote-controlled mobile machine using flexible shafts comprising:

a first flexible shaft having a first torque transmission driving wire inserted into a first tube;

a second flexible shaft having a second torque transmission driving wire inserted into a second tube, wherein the first and second flexible shafts are arranged longitudinally adjacent to each other, wherein one ends of said first and second flexible shafts are respectively connected to power sources, and the other ends thereof are respectively connected to a pair of left and right crawler mechanisms being a driven side;

wherein the crawler mechanisms are driven/controlled by remote control via said first and second flexible shafts to make said mobile machine travel;

wherein bearings rotatably support the first and second driving wires in the first and second tubes, respectively, and the bearings are arranged in said first flexible shaft and said second flexible shaft, respectively, and wherein each bearing comprises:

a flange portion fixed to a flange portion of an adjacent bearing; and a stopper that is attached to a side of the bearing and fixed to a corresponding one of the first and second driving wires.

2. A remote-controlled mobile machine using flexible shafts comprising:

a first flexible shaft having a first torque transmission driving wire inserted into a first tube;

second flexible shaft having a second torque transmission driving wire inserted into a second tube, wherein the first and second flexible shafts are arranged longitudinally adjacent to each other, wherein one ends of said first and second flexible shafts are respectively connected to power sources, and the other ends thereof are respectively connected to a pair of left and right crawler mechanisms being a driven side;

wherein the crawler mechanisms are driven/controlled by remote control via said first and second flexible shafts to make said mobile machine travel;

wherein the first and second driving wires are each composed of a wire of multi-layer structure having a twist direction thereof being reversed at every layer;

wherein the crawler mechanisms are designed to rotate in a same direction or an opposite direction in accordance with coincidence or non-coincidence of rotational directions of a pair of driving wires wherein bearings rotatably support the first and second driving wires in the first and second tubes, respectively, and the bearings are arranged in said first flexible shaft and said second flexible shaft, respectively, and wherein each bearing comprises:

a flange portion fixed to a flange portion of an adjacent bearing; and a stopper that is attached to a side of the bearing and fixed to a corresponding one of the first and second driving wires.

3. A remote-controlled mobile machine using flexible shafts comprising:

a first flexible shaft having a first torque transmission driving wire inserted into a first tube;

a second flexible shaft having a second torque transmission driving wire inserted into a second tube, wherein the first and second flexible shafts are arranged longitudinally adjacent to each other, wherein one ends of said first and second flexible shafts are respectively connected to power sources, and the other ends thereof are respectively connected to a pair of left and right crawler mechanisms being a driven side;

wherein the crawler mechanisms are driven/controlled by remote control via said first and second flexible shafts to make said mobile machine travel;

wherein said first and second flexible shafts are bound together in parallel as a bundle;

wherein bearings rotatably support the first and second driving wires in the first and second tubes, respectively, and the bearings are arranged in said first flexible shaft and said second flexible shaft, respectively, and wherein each bearing comprises:

a flange portion fixed to a flange portion of an adjacent bearing; and a stopper that is attached to a side of the bearing and fixed to a corresponding one of the first and second driving wires.

4. A remote-controlled mobile machine using flexible shafts comprising:

a first flexible shaft having a first torque transmission driving wire inserted into a first tube;

a second flexible shaft having a second torque transmission driving wire inserted into a second tube, wherein the first and second flexible shafts are arranged longitudinally adjacent to each other, wherein one ends of said first and second flexible shafts are respectively connected to power sources, and the other ends thereof are respectively connected to a pair of left and right crawler mechanisms being a driven side;

wherein the crawler mechanisms are driven/controlled by remote control via said first and second flexible shafts to make said mobile machine travel;

wherein the first and second driving wires are each composed of a wire of multi-layer structure having a twist direction thereof being reversed at every layer wherein the crawler mechanisms are designed to rotate in a same direction or an opposite direction in accordance with coincidence or non-coincidence of rotational directions of a pair of driving wires;

wherein said first and second flexible shafts are bound together in parallel as a bundle;

wherein bearings rotatably support the first and second driving wires in the first and second tubes, respectively, and wife the bearings are arranged in said first flexible shaft and said second flexible shaft, respectively, and wherein each bearing comprises:

a flange portion fixed to a flange portion of an adjacent bearing; and a stopper that is attached to a side of the bearing and fixed to a corresponding one of the first and second driving wires.

5. The remote-controlled mobile machine using the flexible shafts according to claim 1, further comprising an imaging device mounted on a main body of said mobile machine, wherein said mobile machine can be operated by remote control while monitoring a video obtained by said imaging device, wherein said mobile machine can be operated by remote control while monitoring a video obtained by said imaging device.

6. The remote-controlled mobile machine using the flexible shafts according to claim 2, further comprising an imaging device mounted on a main body of said mobile machine, wherein said mobile machine can be operated by remote control while monitoring a video obtained by said imaging device.

7. The remote-controlled mobile machine using the flexible shafts according to claim 3, further comprising an imaging device mounted on a main body of said mobile machine, wherein said mobile machine can be operated by remote control while monitoring a video obtained by said imaging device.

8. The remote-controlled mobile machine using the flexible shafts according to claim 4, further comprising an imaging device mounted on a main body of said mobile machine, wherein said mobile machine can be operated by remote control while monitoring a video obtained by said imaging device.

* * * * *